US005933674A

United States Patent [19]

Fyson

[11] Patent Number: 5,933,674

[45] Date of Patent: Aug. 3, 1999

[54] PROCESSING OF PHOTOGRAPHIC LIGHT SENSITIVE MATERIALS AND APPARATUS THEREFOR

[75] Inventor: John R. Fyson, London, United Kingdom

[73] Assignee: Eastman Kodak Company, Rochester, N.Y.

[21] Appl. No.: 09/037,587

[22] Filed: Mar. 9, 1998

[30] Foreign Application Priority Data

Mar. 27, 1997 [GB] United Kingdom ..... 9706410

[51] Int. Cl.[6] ..... G03D 3/02

[52] U.S. Cl. ..... 396/626

[58] Field of Search ..... 396/626, 636; 118/602, 429; 134/22.11, 99.1

[56] References Cited

U.S. PATENT DOCUMENTS 4,346,981 8/1982 Kaufmann ..... 396/626
4,466,072 8/1984 Kaufmann ..... 396/570

FOREIGN PATENT DOCUMENTS 0 251 178 1/1988 European Pat. Off. .

*Primary Examiner*—D. Rutledge
*Attorney, Agent, or Firm*—Frank Pincelli

[57] ABSTRACT

A process for processing light sensitive photographic materials in which oxidation of replenisher solution in a tubing between replenisher and processing tanks is prevented comprises the steps of processing the light sensitive photographic material in a tank containing a processing solution; and supplying replenisher solution to the processing tank and causing the processing solution to be displaced from the processing tank. Replenisher solution which is supplied to the processing tank is conveyed in a tubing which is coaxial with a further tubing of larger diameter containing a solution of an oxygen scavenger such as a reducing agent which can be provided by displaced processing solution. The invention also provides for a processing apparatus for processing light sensitive photographic materials which comprises a processing tank for containing a processing solution with which the light sensitive photographic material is to be processed; a replenisher tank for holding replenisher solution; and a tubing connecting the processing and replenisher tanks for supplying replenisher solution from the replenisher tank to the processing tank. The tubing is coaxial with a further tubing of larger diameter for carrying a solution containing an oxygen scavenger.

12 Claims, 1 Drawing Sheet

PROCESSING OF PHOTOGRAPHIC LIGHT SENSITIVE MATERIALS AND APPARATUS THEREFOR

FIELD OF THE INVENTION

This invention relates to the processing of photographic light sensitive materials and to an apparatus for use in the process.

BACKGROUND OF THE INVENTION

It is well known that in the processing of photographic light sensitive materials the processing solution has to be made up with fresh solution known as replenisher solution and that it is necessary to remove used processing solution either periodically or continuously from the tank in which it is held. This is usually carried out by causing the addition of the replenisher solution to displace processing solution from its tank. This displaced processing solution may then be discarded or, more commonly, treated in some way to recover components of value.

For example U.S. Pat. No. 3,418,913 discloses a processor having a plurality of tanks for holding processing solutions, including a developer solution and a fixer solution followed by a tank for water for washing the photographic material. The processing solutions in the tanks are recirculated by withdrawing the solution through a filter located within the tank and then pumping the solution through a heat exchanger and back to the tank. Replenishment solutions are provided through a replenishment line or conduit under the control of solenoid operated valves. The replenishment solution is provided downstream from the outlet of the tank and before the solutions reach the pump so that the replenishment solution is mixed with solution from the tank and cooled prior to being delivered to the tank with previously used solution.

U.S. Pat. No. 5,353,085 discloses an automatic processing system which includes replenishment with a concentrated solution and in which used processing solution is treated by a series of steps including evaporation and electro-dialysis.

Further U.S. Pat. No. 5,184,165 also describes an automatic processing system which eliminates the need for manual mixing of the processing solutions.

PROBLEM TO BE SOLVED BY THE INVENTION

In certain situations the replenisher solution may have to flow a significant distance from the tank where it is held or made up to the processing tank where it is used. Such a situation might arise for example in a supermarket where the processing takes place in the customer area and the solutions are stored and made up in another part of the supermarket some distance away from the customer. The displaced processing solution may also be removed to a remote area for collection and safe disposal. The tubing which is used for the transport of the replenisher solution and the displaced processing solution is conventionally made of materials such as silicone rubber or sometimes polyurethane. These materials provide the required flexibility but are slightly permeable to oxygen and water vapor. This is noticeable for example when the solution stands in the tubing for any length of time such as overnight. Oxygen may diffuse into the solution leading to oxidation of the replenisher and water may be lost through the wall of the tubing thus tending to increase the concentration of the solution. When the processor is started up after the break and the processing solution is replenished using this oxidized and concentrated solution, the constitution of the processing solution will be caused to change and thereby change the sensitometry of the processed photographic materials. This effect may last until the oxidised replenisher has been flushed out of the system.

The present invention solves this problem wherein the tubing used to convey the replenisher is coaxial with a tubing of larger diameter carrying a solution containing an oxygen scavenger.

SUMMARY OF THE INVENTION

According to the invention a processing apparatus for processing light sensitive photographic materials comprises a processing tank (10) for containing a processing solution (20) with which the light sensitive photographic material is to be processed; a replenisher tank (130) for holding replenisher solution (140); and a tubing (60) connecting the processing and replenisher tanks (10,130) for supplying replenisher solution from the replenisher tank (130) to the processing tank (10). The tubing (60) is coaxial with another tubing (70) of larger diameter for carrying a solution containing an oxygen scavenger.

Conveniently the processing tank (10) has an outlet (40) for the discharge of displaced processing solution communicating with the tubing (70) of larger diameter.

ADVANTAGEOUS EFFECT OF THE INVENTION

The apparatus of the invention provides a way of transporting replenisher solutions over long distances, typically 50 or 100 meters or more, in flexible tubing with reduced risk of oxidation caused by diffused oxygen or concentration increase caused by water loss from the replenisher solution.

The invention may also with advantage be used when the processing and replenisher tanks are closer together so that the tubing is less than for example 50 meters in length when the processing is carried out intermittently for example with an overnight stop. In such a process the replenisher solution will stand in the tubing for whatever period the process is not running.

The invention is particularly applicable to replenished chemical systems having an overflow for displaced processing solution and where the concentration of the processing solution is critical.

DETAILED DESCRIPTION OF THE INVENTION

Figure 1:
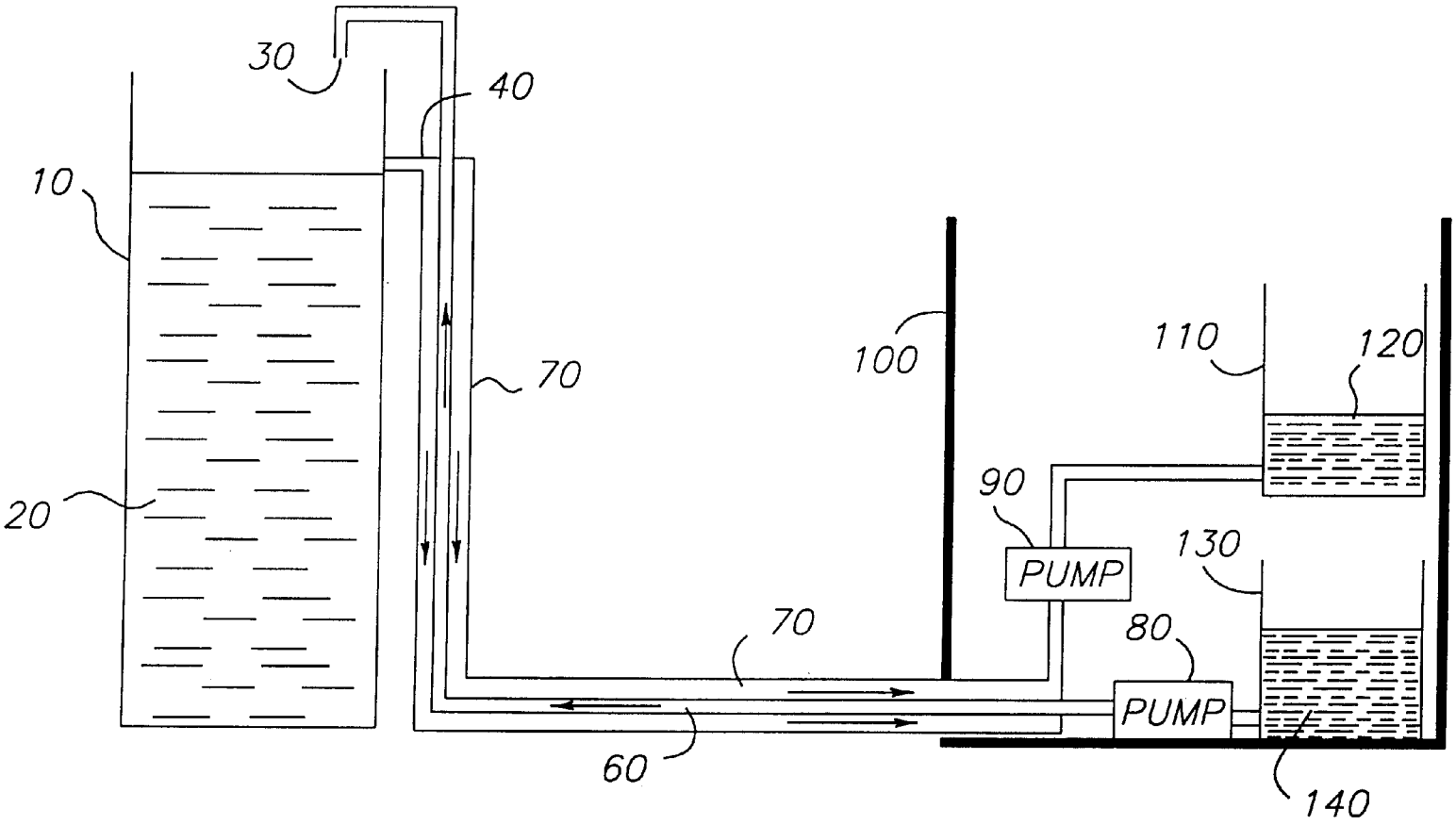
FIG. 1 illustrates a flow sheet showing the arrangement of replenisher and processing tanks and the connections between them.

The term light sensitive photographic materials includes photographic paper and film.

The term coaxial in the present specification is intended to include any arrangement where one tubing lies inside the other and is therefore not limited to an arrangement where the axes of the tubings lie on the same line and the term annular when used in the specification should be construed accordingly.

Further the tubings do not need to be coaxial for their entire length, although it is preferred that the tubing which is to carry the replenisher solution is within the tubing which is to carry the oxygen scavenger for a substantial proportion, preferably a major proportion, of its length.

There may be more than one tubing for replenisher solution e.g. one for developer replenisher and one for fixer replenisher.

Both or all of such tubings are preferably within a tubing of larger diameter. A particularly convenient arrangement is for both or all the tubings intended to carry replenisher to be within one larger tubing which is to carry a solution containing a reducing agent.

The replenisher tank may be a small container to act as a reservoir for holding solution to be fed to the processing tank.

The apparatus may include a further tank for holding displaced processing solution and the tank for holding the displaced solution may be located with the tank for holding the replenisher solution at a location remote from the tank for holding the processing solution.

The present invention also provides an assembly for connection to an already installed processing tank to provide a processing system.

Thus according to another aspect of the present invention an assembly for connection to a processing tank to provide a processing apparatus for processing light sensitive photographic materials comprises a replenisher tank (130) for holding replenisher solution (140); and a tubing (60) connected to the replenisher tank (130) and for connection to a processing tank (10) whereby, when connected, replenisher solution may be supplied from the replenisher tank (130) to the processing tank (10).

The tubing (60) is coaxial with a tubing (70) of larger diameter for carrying a solution of an oxygen scavenger.

The tubing (70) of larger diameter is preferably suitable for connection to an outlet (40) in the processing tank (10) whereby processing solution may be displaced into the tubing.

The present invention also provides a process for processing light sensitive photographic materials.

Thus according to another aspect of the present invention there is provided a process for processing light sensitive photographic materials comprising the steps of processing the light sensitive photographic material in a tank (10) containing a processing solution (20); and supplying replenisher solution (140) to the processing tank (10) and causing processing solution (20) to be displaced from the processing tank (10)

The replenisher solution (140) which is supplied to the processing tank (10) is conveyed in a tubing (60) which is coaxial with a tubing (70) of larger diameter containing a solution of an oxygen scavenger.

The oxygen scavenger may be any substance that absorbs or reacts with oxygen. Conveniently it will be a reducing agent, for example, a sulphite or a color developer and may conveniently be provided by used processing solution such as that displaced from the processor.

The processing of the light sensitive photographic material employing the processing solution may be carried out at a location remote from where the replenisher solution is made up or held.

While processors typically comprise several tanks for holding processing solutions, such as developer solution and fixer solution, only a single processing tank will be shown and described since the invention can be used with solutions of developer, fixer etc.

Referring to FIG. 1, the apparatus comprises a remote unit 100 (so called because it is remote e.g. 50 meters or more, from a processing tank 10) which comprises a replenisher tank 130 holding replenisher solution 140 and a waste tank 110 holding used solution 120.

A processing tank 10 containing processing solution 20 is located at a significant distance e.g. 100 meters from the replenisher tank 130. Connecting the two tanks 130 and 10 is a tubing 60 for the supply of replenisher solution to the processing tank 10. A pump 80 is provided to pump the replenisher solution 140 to the processing tank 10.

Tank 10 has an overflow 40 for the escape of displaced processing solution and the overflow 40 is connected to a tubing 70 which is of larger diameter than tubing 60, tubing 60 being coaxial with tubing 70.

Tubing 70 has a pump 90 for pumping displaced solution to tank 110 where the solution 120 is held for collection.

In use, on demand from the processor, replenisher solution 140 is pumped from the tank 130 by pump 80 through tubing 60. The replenisher solution flows through outlet 30 into the bulk of the processing solution in processing tank 10. Processing solution 20 is displaced from the tank 10 through an outlet in the form of an overflow 40 and along tubing 70 in the annular space surrounding the replenisher tubing 60. The displaced processing solution will typically contain color developing agent or sulphite either of which will act as an oxygen scavenger and prevent oxygen diffusing into the replenisher solution in tubing 60. Whether the processing is run continuously or intermittently with an overnight stop and restart in the morning, the replenisher solution will reach the processing tank 10 without having been oxidized by oxygen diffusing through the wall of tubing 60 or without losing water through the tubing wall.

The displaced processing solution flows counter current to the replenisher solution. The displaced processing solution flows into tank 110 where it is mixed with other effluent to form mixed solution 120.

The pump 90 may be required to satisfactorily transfer the displaced solution to tank 110. The pumps 80 and 90 may be located at any suitable point in the tubings 60 and 70.

The apparatus also gives an advantage where the processing and replenisher tanks are closer together e.g. less than 50 meters apart, when the processing is intermittent so that replenisher solution stands in the tubing for periods of time such as overnight.

The invention has been described in detail with particular reference to certain preferred embodiments thereof, but it will be understood that variations and modifications can be effected within the spirit and scope of the invention.

What is claimed is:

1. A processing apparatus for processing light sensitive photographic materials comprising:

a processing tank for containing a processing solution with which the light sensitive photographic material is to be processed;

a replenisher tank for holding replenisher solution; and a tubing connecting said processing tank and said replenisher tank for supplying replenisher solution from the replenisher tank to the processing tank;

wherein said tubing is coaxial with another tubing of larger diameter for carrying a solution containing an oxygen scavenger.

2. An apparatus as claimed in claim 1, wherein the processing tank has an outlet for the discharge of displaced processing solution communicating with the tubing of larger diameter.

3. An apparatus as claimed in claim 2, wherein the tubing of larger diameter is connected to a tank for holding displaced processing solution.

4. An apparatus as claimed in claim 3, wherein the tank for holding the displaced solution is located with the tank for holding the replenisher solution at a location remote from the tank for holding the processing solution.

5. An apparatus as claimed in any claim 1, wherein the replenisher tank is remote from the processing tank.

6. An assembly for connection to a processing tank to provide a processing apparatus for processing light sensitive photographic materials, said assembly comprising:

a replenisher tank for holding replenisher solution; and a tubing connected to the replenisher tank and for connection to a processing tank whereby, when connected, replenisher solution may be supplied from the replenisher tank to the processing tank;

wherein the tubing is coaxial with a further tubing of larger diameter for carrying a solution of an oxygen scavenger.

7. An assembly as claimed in claim 6, wherein the tubing and the further tubing are of sufficient length that the replenisher tank may be connected to a processing tank which is remote therefrom.

8. A process for processing light sensitive photographic materials, the process comprising the steps of:

processing light sensitive photographic material in a processing tank containing a processing solution; and supplying replenisher solution to the processing tank and causing processing solution to be displaced from the processing tank;

wherein the replenisher solution which is supplied to the processing tank is conveyed in a tubing which is coaxial with a further tubing of larger diameter containing a solution of an oxygen scavenger.

9. A process as claimed in claim 8, wherein the oxygen scavenger is a reducing agent.

10. A process as claimed in claim 8, wherein the solution containing the oxygen scavenger is used processing solution.

11. A process as claimed in claim 10, wherein said used processing solution is displaced from the processing tank.

12. A process as claimed in claim 8, wherein the processing of the photographic materials is intermittent.

* * * * *